US005651201A

United States Patent [19]

Farley

[11] Patent Number: 5,651,201

[45] Date of Patent: Jul. 29, 1997

[54] IRONING MITT WITH FLEXIBLE SOLEPLATE

[76] Inventor: Brent Lee Farley, 4213 Connecticut Ave., Baltimore, Md. 21229

[21] Appl. No.: 519,927

[22] Filed: Aug. 28, 1995

[51] Int. Cl.[6] ..... D06F 75/30; D06F 75/38; H05B 3/34

[52] U.S. Cl. ..... 38/88; 38/89; 38/93; 219/528; 219/255

[58] Field of Search ..... 38/74, 75, 778, 38/77.82, 81, 88, 89, 90, 91, 92, 93, 95, 97; 2/158, 159, 905, 20; 219/211, 223, 227, 254, 255, 527, 528, 529; 417/472; 137/341

[56] References Cited

U.S. PATENT DOCUMENTS

| | | | |
|---|---|---|---|
| 997,565 | 7/1911 | Carson | 38/95 |
| 2,065,366 | 12/1936 | Eichorn | 38/93 |
| 2,314,498 | 3/1943 | Hoagland | 38/103 X |
| 2,408,209 | 9/1946 | Gould | 38/88 X |
| 3,632,966 | 1/1972 | Arron | 2/905 X |
| 3,793,753 | 2/1974 | Engelbart | 38/95 X |
| 4,570,269 | 2/1986 | Berlese | 2/20 X |

*Primary Examiner*—Ismael Izaguirre

[57] ABSTRACT

An iron having a mitt component and a heating element subdivided into at least two portions. A pivot interconnects the at least two portions of the heating element. A reservoir system interconnects a fluid tank to the heating element to enable the iron to possess steam generating capabilities. The mitt is preferably attached to the heating element by an annular crimping portion. The mitt further includes a pocket for receiving the hand of a user.

8 Claims, 2 Drawing Sheets

FIG. 3
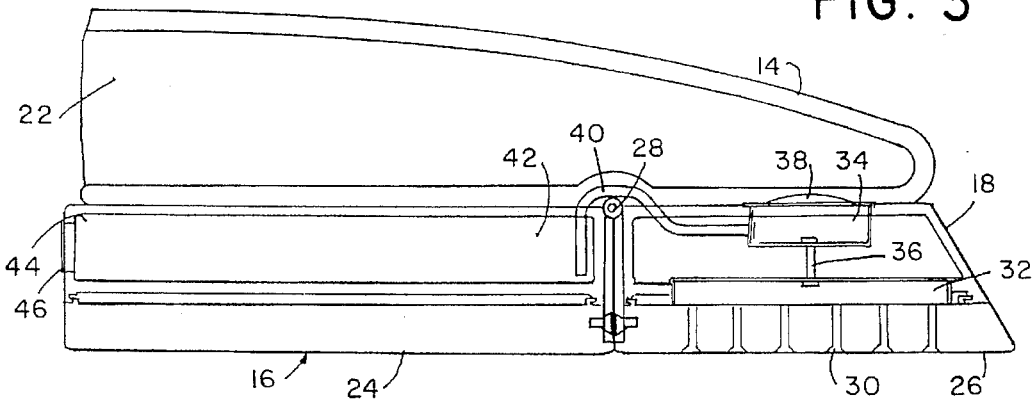
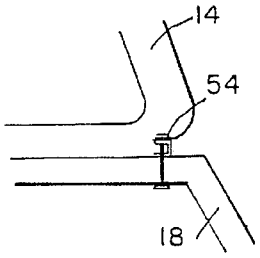
FIG. 4B
FIG. 6A
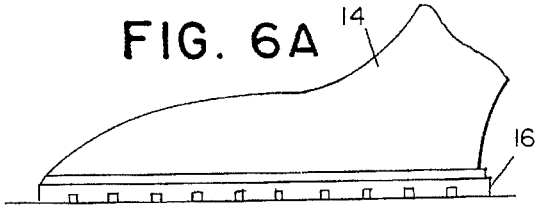
FIG. 7A
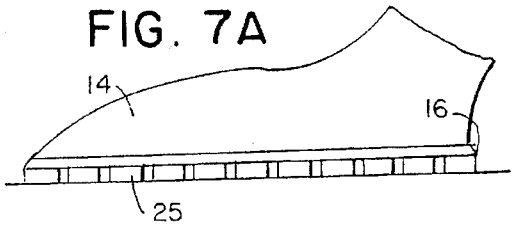
FIG. 6B
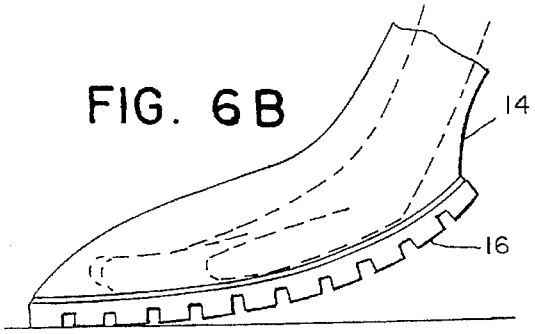
FIG. 7B
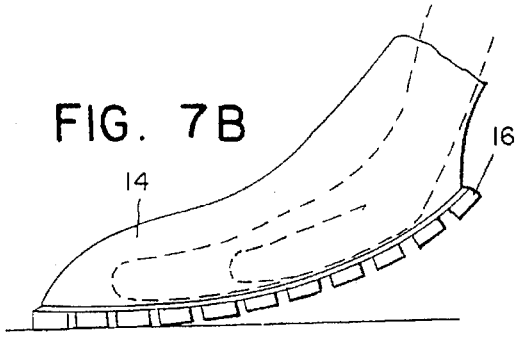

IRONING MITT WITH FLEXIBLE SOLEPLATE

BACKGROUND OF THE INVENTION

1. Field of the Invention

The present invention relates generally to household irons used to iron clothing as well as fabric mitts used to hold hot articles such as baking pans removed from an oven.

2. Description of the Related Art

The art to which the invention relates includes a variety of conventional irons and ironing devices used for ironing the wrinkles from clothing. The art also includes mitts and gloves used to shield a person's hand from a hot object such as a baking pan or other pot or pan removed from a stove or oven.

Conventional irons have a substantially rigid, planar ironing surface that becomes hot when energized. Thus, conventional irons are known to be useful for ironing wrinkles from clothing, but are somewhat cumbersome and difficult to manipulate into corners and crevices of the article being ironed. That is, the substantially planar ironing surface makes it difficult for the user of such a device to iron contoured surfaces such as sleeves, collars and shoulders of shirts and blouses.

Until now, however, an ironing device incorporating a mitt and a flexible ironing pad, whether it be comprised of tubular elements or a single flexible heating element, capable of ironing hard to reach surfaces and is more easily controlled by the hand of the user, has not been invented.

SUMMARY OF THE INVENTION

The preferred embodiment of the present invention includes a heating element of a flexible or pivoting design attached to an insulated mitt for receiving the hand of the user. The mitt may be permanently or removably attached to the heating element so long as positive communication between the mitt and the hot ironing elements is maintained during use.

The ironing mitt can be of any conventional construction such as those associated with insulated mitts used in the kitchen while baking or removing hot objects from the stove or oven. The heated element(s) may comprise a flexible material, planar in shape but capable of bending in to a user's manipulation of the device, or it may comprise a plurality of heating bars, each of which are preferably independent to enable the ironing mitt and heating element assembly to be flexed in a desired fashion. In either case, such a device would tend to lessen the problems associated with ironing difficult or hard to reach places on the garment.

The present invention may, therefore, be summarized in a variety of ways, one of which is the following: an iron, comprising: a heating element having at least two portions pivotally connected to one another enabling the heating element to flex; and a mitt attached to the heating element. The heating element may be further comprised of: a front portion and a rear portion and a pivot is operably positioned therebetween.

The iron may further include steam generating means for producing steam from a fluid such as water. The steam generating means may further comprise reservoir means for holding the fluid and suction means for moving the fluid within the reservoir means; and the reservoir means may further include: a tank, a fluid reservoir, a steam reservoir, and at least one conduit interconnecting the tank with the fluid reservoir.

In addition, the alternate embodiments of the invention may also include a plurality of heating element portions operably interconnected to enable each portion to pivot one with respect to the other, an annular crimping strip to attach the mitt to the heating element, and a plurality of steam ports. The mitt further include a pocket for receiving the hand of a user.

It is an object of the present invention to provide an ironing mitt.

It is an object of the present invention to provide an ironing mitt with an insulated glove or mitt component attached to a flexible heating element.

BRIEF DESCRIPTION OF THE DRAWINGS

FIG. 3 is a cross-sectional view of the embodiment of the present invention shown in FIG. 2;

FIG. 4B is an enlarged view of a manner of attaching the mitt component of the present invention to the heating element component;

FIGS. 6A and 6B are side views of an alternate embodiment of the present invention; and FIGS. 7A and 7B are side views of an alternate embodiment of the present invention shown in FIGS. 6A and 6B.

DETAILED DESCRIPTION OF THE PREFERRED EMBODIMENT(S)

Figure 1:
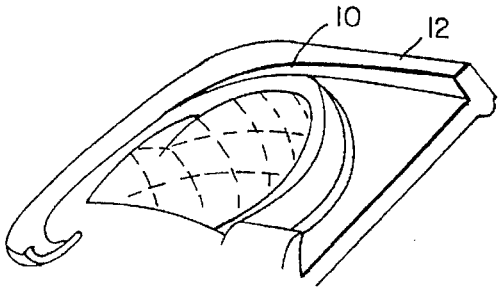
FIG. 1 is an elevated perspective view of an embodiment of the present invention shown in relation to a base unit.
Figure 5:
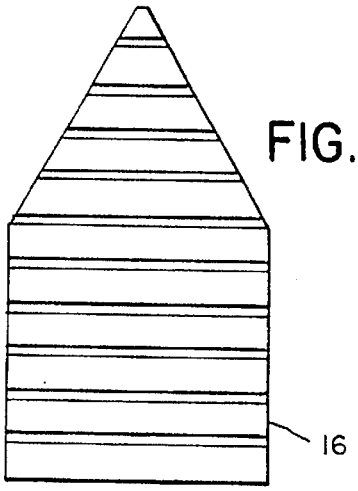
FIG. 5 is a bottom view of an alternate embodiment of the present invention.
Figure 2:
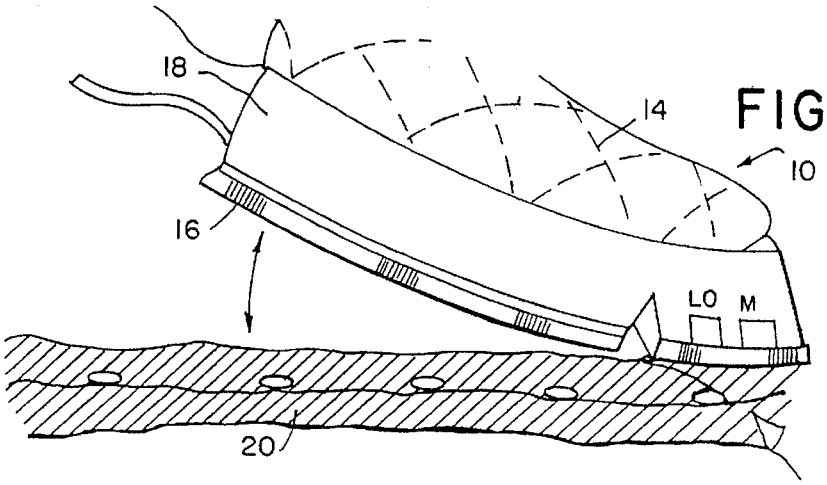
FIG. 2 is an elevated perspective view of an embodiment of the present invention shown in use.

With reference to FIGS. 1 and 2, an embodiment of the present invention is designated generally by the reference numeral 10. Embodiment 10 is shown in a rest position in cooperation with a base unit 12 which serves as a heat sink when the embodiment 10 rests thereon while radiating heat. Embodiment 10 includes a mitt component 14, and a flexible heating element component 16. A housing 18 interpositioned between the mitt 14 and heating element 16 and is associated with the heating element 16 to comprise a part thereof. In FIG. 2, embodiment 10 is shown adjacent a piece of fabric or garment 20 which is being ironed.

Figure 4A:
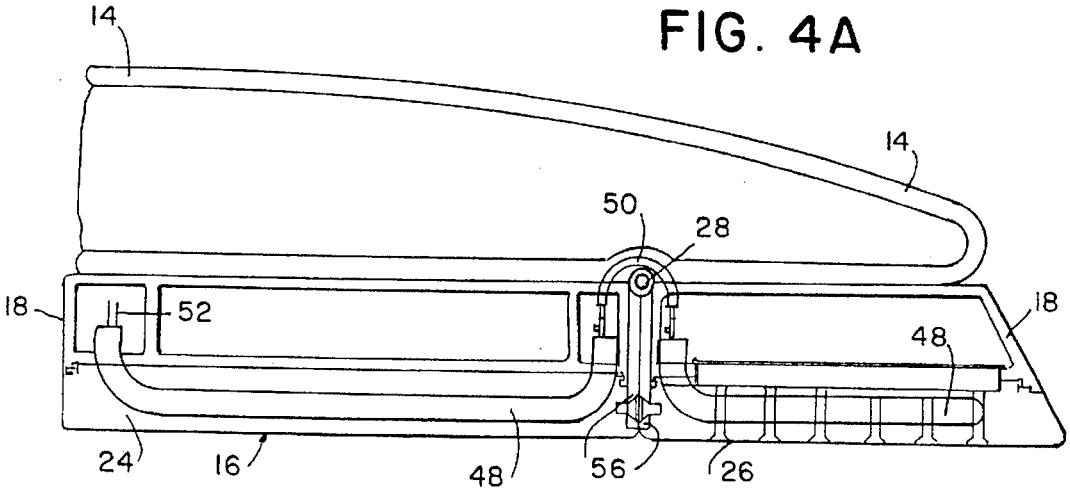
FIG. 4A is an alternate cross-sectional view of the embodiment shown in FIG. 2.

With reference to FIGS. 3 and 4A–B, mitt component 14 further includes a pocket 22 for receiving the hand and wrist of the user (see FIGS. 6B and 7B as indicated by the dashed lines). Heating element 16 further includes a first component or rear portion 24 and a front portion 26. The two are in pivotal operable communication with one another by hinge 28. Thus, portions 24 and 26 are allowed to pivot, one with respect to the other at the hinge 28.

Front portion 26 further includes a plurality of steam ports 30 which are in communication with a steam reservoir 32 which, in turn, is in communication with a fluid reservoir 34 by flow tube 36. Pressure delivery bubble 38 is preferably formed of an elastomeric material for flexibility and is positioned below mitt 14, but is adjacent to it to enable the user to depress the bubble 38 from the interior of the pocket 22.

Reservoir tube 40 is in communication with a tank 42 which is a substantially closed compartment having an opening 44, the closure of which is achieved by fill cap 46.

In use, the user simply removes the fill cap 46 and introduces water into the tank 42 through the opening 44 and replaces the fill cap. When the user places their hand into the compartment 22 or the mitt 14 and depresses bubble 38, which is preferably an elastomeric material capable of assuming a memory shape as shown in FIG. 3 after it is depressed, causes a suction force to draw fluid from the tank 42 through the conduit 40 into fluid reservoir 34. In this manner, the fluid entering fluid reservoir 34 is allowed to pass through conduit 36 into stem reservoir 32 to create stem which is expelled through the stem ports 30 of the base portion 26.

When the bubble 38 is allowed to flex back to its rest convex position, a vacuum is created in the conduit 40 to enable fluid to be drawn into the reservoir 34.

With reference to FIG. 4, a coaxial heating element 48 is present in both the first portion 24 and front or second portion 26 of the base heating element 16. Thus, coaxial element 48 may be a bifurcated construction as shown in the figure. Electrical connection 50 is provided to pass electrical energy to the heating element 48 positioned in both the first and second portions 24 and 26 of the base heating element 16. Thus, electrical energy is introduced through a connection 52 and the preferred coaxial resistive heating elements 48 are in the form of simple resistors which heat up in response to the electrical energy supplied through connection 52.

With reference to FIG. 4B, the attachment of the mitt 14 to the housing 18 is accomplished by an annular crimping strip 54 which effectively secures the mitt portion 14 to the housing 18. The interface between the heating elements 24 and 26 is preferably shielded with an aluminum strip 56 which also serves as a stop to ensure that element 24 and element 26 remain in the proper pivotal orientation during use such that a substantially planar surface is created on the bottom surface of the elements 24 and 26.

Thus, it is contemplated that first and second heating element portions 24 and 26 may be provided, but in alternate embodiments, a plurality of elements (more than two) is also contemplated as is a single element having a flexible configuration of virtually any suitable material capable of allowing heat transfer from the resistive heating element 48 to the base heating element portions comprising base heating element 16.

Thus, with reference to FIGS. 5, 6A–6B, and 7A–7B, mitt component 14 may be shown in communication with alternate base heating element structures 16 such that in FIGS. 6A and 6B a single flexible heating element 16 is provided and in FIGS. 7A and 7B a plurality of hinged heating elements 25 are provided.

These and other embodiments of the present invention shall become apparent after consideration of the scope of the specification and drawings set forth herein. All such alternate embodiments and equivalents are believed to be contemplated as part of the present invention whose only limitation is the scope of the appended claims attached hereto.

What is claimed is:

1. An iron, comprising:

a heating element having at least two portions pivotally connected to one another enabling the heating element to flex;

a mitt attached to the heating element;

steam generating means for producing steam from a fluid; and reservoir means for holding the fluid and suction means for removing the fluid from the reservoir means.

2. The iron of claim 1, such that the heating element is further comprised of:

a front portion and a rear portion and a pivot is operably positioned therebetween.

3. The iron of claim 1, such that the reservoir means further includes:

a tank, a fluid reservoir and a steam reservoir.

4. The iron of claim 3, further including:

at least one conduit interconnecting the tank with the fluid reservoir.

5. The iron of claim 1, further including:

a plurality of heating element portions operably interconnected to enable each portion to pivot one with respect to the other.

6. The iron of claim 1, further including:

an annular crimping strip to attach the mitt to the heating element.

7. The iron of claim 1, such that the heating element further includes:

a plurality of steam ports.

8. The iron of claim 1, such that the mitt further includes:

a pocket for receiving the hand of a user.

* * * * *